US006300719B1

(12) United States Patent
Tlaga et al.

(10) Patent No.: US 6,300,719 B1
(45) Date of Patent: Oct. 9, 2001

(54) DRIVE SCHEME FOR LOW PRESSURE GAS DISCHARGE LAMPS

(75) Inventors: Waldemar Tlaga; Jerzy Hoja, both of Gdansk (PL); Björn Gysell, Sollentuna; Bengt Palmquist, Hestra, both of (SE)

(73) Assignee: PLS Systems I Hestra AB, Hestra (SE)

( * ) Notice: Subject to any disclaimer, the term of this patent is extended or adjusted under 35 U.S.C. 154(b) by 0 days.

(21) Appl. No.: 09/640,432

(22) Filed: Aug. 17, 2000

Related U.S. Application Data

(63) Continuation of application No. PCT/SE99/00219, filed on Feb. 17, 1999.

(30) Foreign Application Priority Data

Feb. 18, 1998 (SE) ..... 9800471

(51) Int. Cl.[7] ..... H05B 39/00

(52) U.S. Cl. ..... 315/94; 315/106; 315/291; 315/307

(58) Field of Search ..... 315/94–99, 106, 315/107, 158, 291, 307

(56) References Cited

U.S. PATENT DOCUMENTS

| | | | | |
|---|---|---|---|---|
| 4,329,622 | * | 5/1982 | Corona et al. | 315/49 |
| 4,798,997 | * | 1/1989 | Egami et al. | 315/115 |
| 4,870,327 | | 9/1989 | Jorgensen | 315/307 |
| 4,958,108 | | 9/1990 | Jorgensen | 315/307 |
| 5,107,184 | * | 4/1992 | Hu et al. | 315/291 |
| 5,481,163 | * | 1/1996 | Nakamura et al. | 315/308 |
| 5,592,052 | * | 1/1997 | Maya et al. | 315/291 |
| 5,600,211 | * | 2/1997 | Luger | 315/307 |
| 5,659,227 | * | 8/1997 | Ushiro et al. | 315/158 |
| 5,703,441 | | 12/1997 | Steigerwald et al. | 315/307 |
| 5,714,848 | * | 2/1998 | Hilbig et al. | 315/334 |

FOREIGN PATENT DOCUMENTS

| | | |
|---|---|---|
| 0 413 991 | 2/1991 | (EP) . |
| 2 212 995 | 8/1989 | (GB) . |
| 2 260 039 | 3/1993 | (GB) . |

* cited by examiner

*Primary Examiner*—Don Wong
*Assistant Examiner*—Tuyet T. Vo
(74) *Attorney, Agent, or Firm*—Pillsbury Winthrop LLP

(57) ABSTRACT

A drive scheme for low-pressure gas discharge lamps is provided with automatic detection of the type of the lamp and automatic adjustment of discharge current and heating current to the values required by detected lamp. Two independent circuit loops deliver energy to two main lamp circuits: discharge loop and filament heating loop from independently regulated energy sources. Discharge current is supplied from high frequency current source, heating currents are supplied from independent voltage sources. Computer based control module senses the value of discharge voltage, discharge current and heating current and provides automatic detection of type of the lamp and automatic of the parameters of independent current and voltage sources according to the values required by actually driven lamp.

1 Claim, 4 Drawing Sheets

DRIVE SCHEME FOR LOW PRESSURE GAS DISCHARGE LAMPS

This application is a continuation of PCT/SE99/00219, filed Feb. 17, 1999.

BACKGROUND OF THE INVENTION

The invention relates to methods and means for driving low pressure gas discharge lamps and, particularly, to flourescent lamps of that type. Commercial low pressure gas discharge lamps are basically low pressure mercury or sodium vapor discharge lamps designed to emit a maximum portion of energy of mercury or sodium spectrum. In the case of flourescent lamps this short wave ultraviolet energy is converted by the phosphor coating the inside of the tubes into visible light. A flourescent gas discharge lamp consists of a glass vessel, usually of tubular shape, coated inside with a phosphor powder. The vessel contains a mixture of one or more noble gases and a small amount of mercury vapor. To operate the lamp a gas discharge is maintained in it, mostly with the help of two electrodes with filaments at the ends of the tube. The discharge process is started and maintained with the aid of conventional magnet control gears or high frequency electronic control gears. Both types of control gears are used to convert the shape of electrical energy available from common AC or DC sources to the form necessary to start and hold up the discharge process. Generally, the energy delivered to the lamp is consumed by two main processes inside the lamp: discharge process and filament heating process. When energized, the state of gas discharge lamp from electrical point of view can be represented by the voltage across the lamp, discharge current flowing through the lamp and heating current flowing through the filaments.

In general, discharge lamps depending on gas mixture parameters as well as physical dimensions and shape will be characterized by different discharge voltage and current and will require different heating voltage. Thus, different control gears are used to drive respective discharge lamps having different ratings.

In a typical solution, the lamp is driven from an AC voltage source. Discharge and heating current is fixed to the value required by the sort of lamp and its constant.

In more advanced solutions, providing dimming of flourescent lamp, partially independent circuits are used to supply heaters of lamp as shown in U.S. Pat. No. 5,703,441. Heating voltage can be regulated while the lamp is entered into dimming mode providing optimal temperature of filaments. However, because discharge current is not regulated, the above solution can be used only to one type of lamp and can not be universal. Change of the lamp type requires changes in design.

Flourescent lamps even of the same size but manufactured by different producers and working under different climatic conditions require different starting voltages. At the same time power converters used to drive lamps have to provide high value of power factor that is equivalent to the resistive load of the mains. U.S. Pat. Nos. 4,870,327 and 4,958,108 are solving above mentioned problems but do not provide means for totally independent regulation of discharge current and heating current what is required for the gear capable to drive the lamp of any type. Proposed solution can be used only to the family of tubes having the same working point defined by discharge voltage and discharge current and varying in starting voltage.

Application of one type of electronic gear to different lamps requires automatic identification of the lamp type. The patent application EP 0413991 A1 attempts to solve that problem using starting voltage of the lamp to identify the type of lamp within a limited and predefined set of lamps. Starting voltage depends on many parameters like tube length and shape, gas mixture type and gas pressure and therefor can not be used as universal parameter identifying the lamp type. Identification algorithm proposed in the mentioned patent application allows only rough identification of the lamps within one limited family.

Fully universal identification of the lamp type can be achieved only through a measurement of all parameters defining electrically the lamp i.e.: discharge voltage, discharge current, heating voltage and heating current and appropriate identification algorithm taking into account all above mentioned parameters.

It is the principal object of this invention to provide a drive scheme for low-pressure gas discharge lamps providing independent supplying of discharge current and filament heating voltage from totally independent and regulated current and voltage sources in order to achieve automatic detection of the type of the lamp and automatic adjustment of discharge current and heating current to the values required by detected lamp.

SUMMARY OF THE INVENTION

According to the present invention, drive scheme for low pressure gas discharge lamps utilized independent current source to deliver discharge current of the lamp and independent voltage or current sources to provide heating of filaments.

Computer based control module senses the value of discharge voltage, value of discharge current and the value of heating voltage and current. Sensed values are used to identify the type of the lamp and to regulate discharge current and heating parameters to provide appropriate driving parameters for actually detected type of the lamp.

DRAWINGS

DESCRIPTION

Although the inventive features of the present invention are applicable to any low pressure gas discharge lamp, the following description is related to flourescent lamps.

Figure 1:
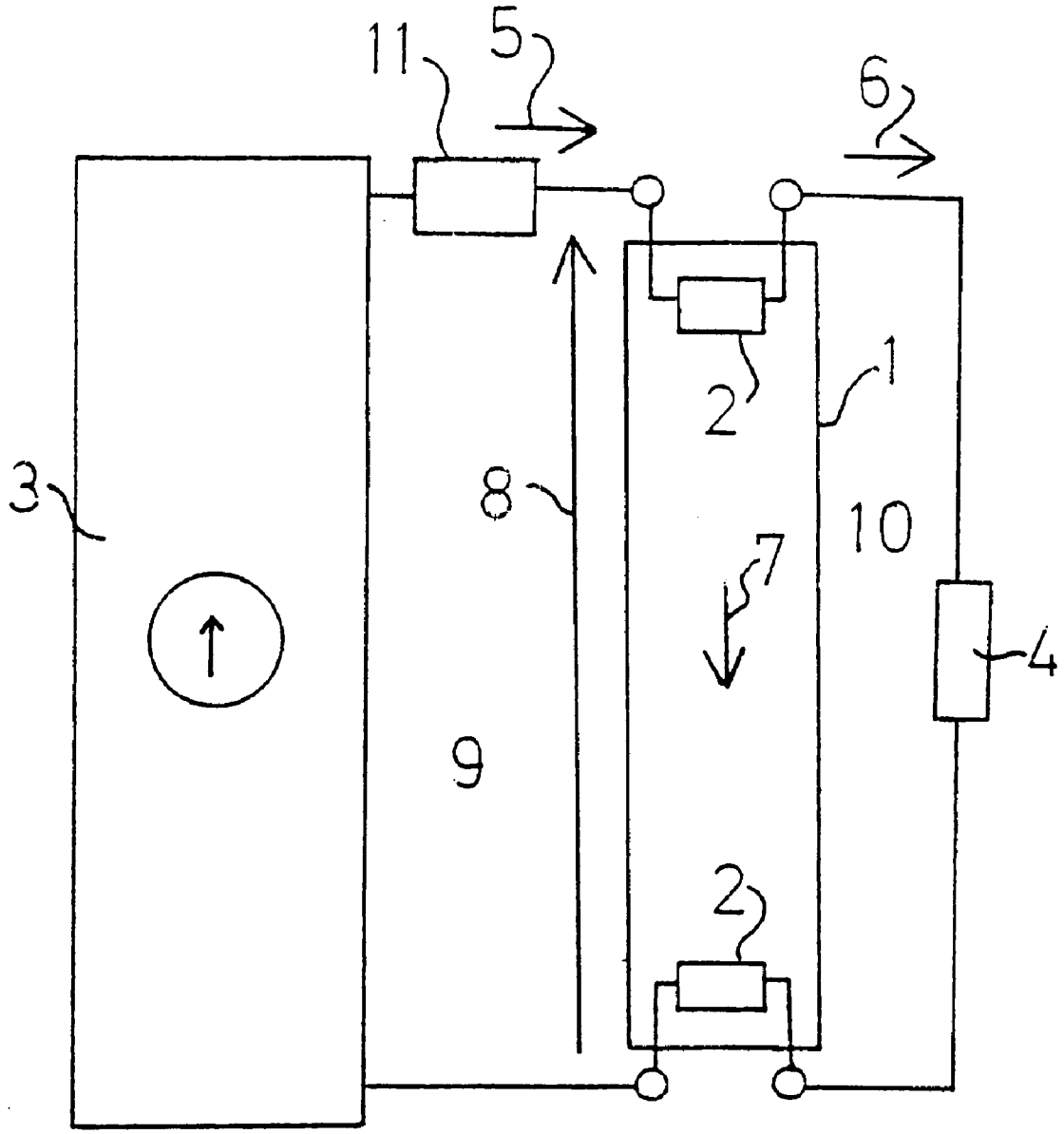
Fig 1 (PRIOR ART)
FIG. 1 shows a prior drive scheme for gas discharge lamps used in prior electronic and magnet control gears, where the parameters of the design has to be individually evaluated for every particular type of lamp in use.

FIG. 1 shows a generalized prior drive scheme for gas discharge lamps. As shown, gas discharge lamp 1, with two electrodes 2 is supplied from AC voltage source 3 with limited positive internal impedance. Because current flowing out from the voltage source depends on the value of load, additional positive impedance component 11 has to be added to adjust current to the value required by appropriate lamp. Energy consumed by the lamp is represented by current vector 5:

$$I_{tot}$$

and a voltage across the lamp is represented by the voltage vector 8:

$$U_t$$

Total current 5 is divided into heating current 6:

$$I_h$$

and discharge current 7:

$$I_d$$

Discharge current 7 and heating current 6 has to be adjusted to values required by the particular type of gas discharge lamp. In the circuit presented in FIG. 1 total current 5 is a sum of discharge current 7 and heating current 6:

$$I_{tot}=I_d+I_h$$

Positive impedance component 4 is added to close heating loop 10 and provide required value of heating current. The value of heating current 6 is defined by the value of the voltage 8 across the lamp 1, parameters of the lamp and the value of impedance components 4 and 11. Because circuit loops 9 and 10 are dependent having a lamp in common branch, both the parameters of voltage source 3, impedance 4 and 11, can be adjusted to only one type of gas discharge lamp defined by discharge current 7, heating voltage 6 and discharge voltage 8.

Figure 2:
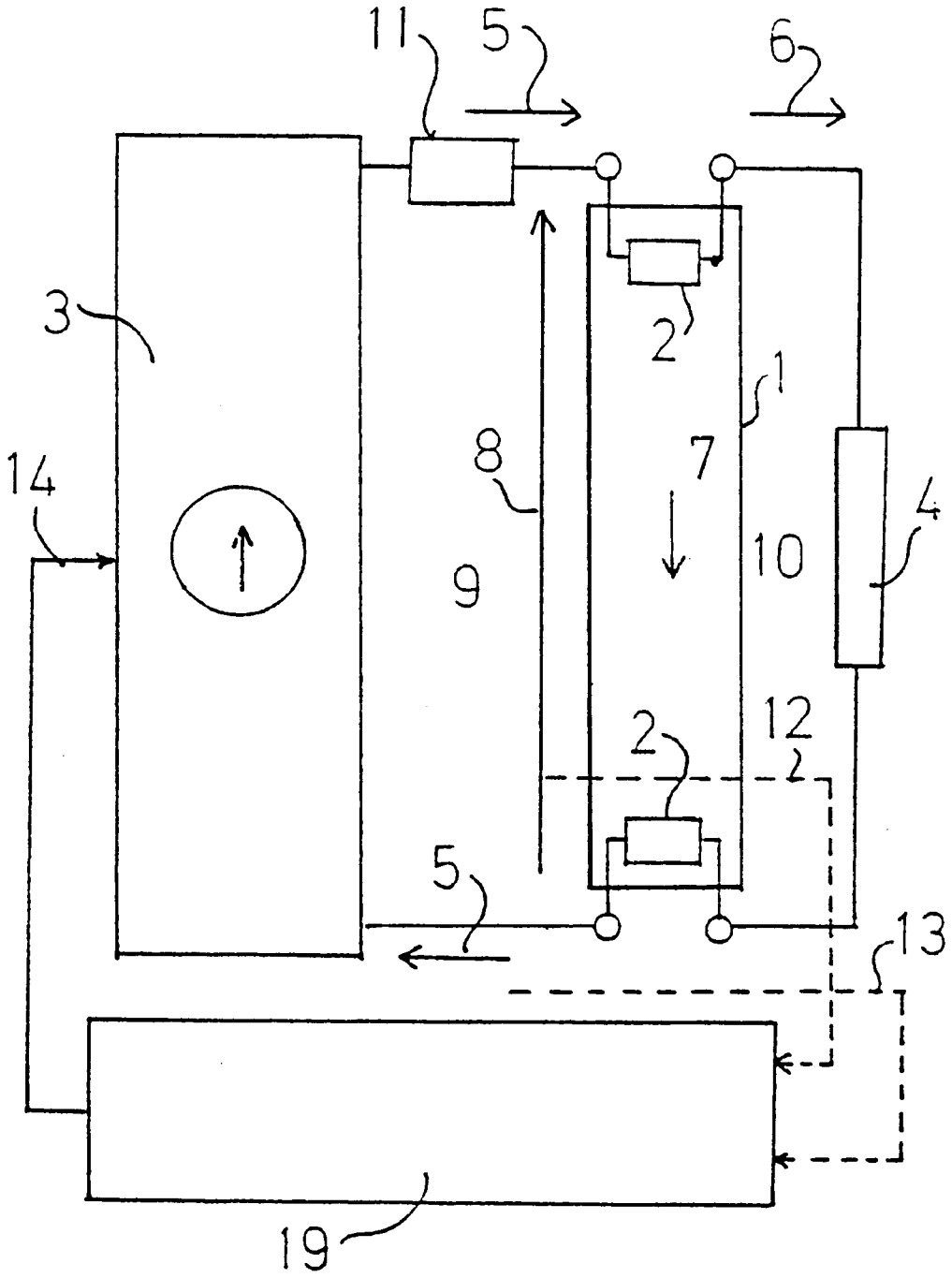
Fig 2 (PRIOR ART)
FIG. 2 shows a prior drive scheme for gas discharge lamps used in prior electronic and magnet control gears, where the parameters of the design has to be individually evaluated for every particular type of lamp in use, additionally equipped with a feedback module providing better stability of predefined parameters.

Some of the designs utilize feedback loop to provide better stability of currents delivered to the lamp. FIG. 2 shows the block diagram of the design where signal 13 sensing total current 5 and signal 12 sensing discharge voltage 8 are processed by the feedback module 11 to evaluate control signal 14 regulating the parameters of energy source to provide stable value of total current 5.

Figure 3:
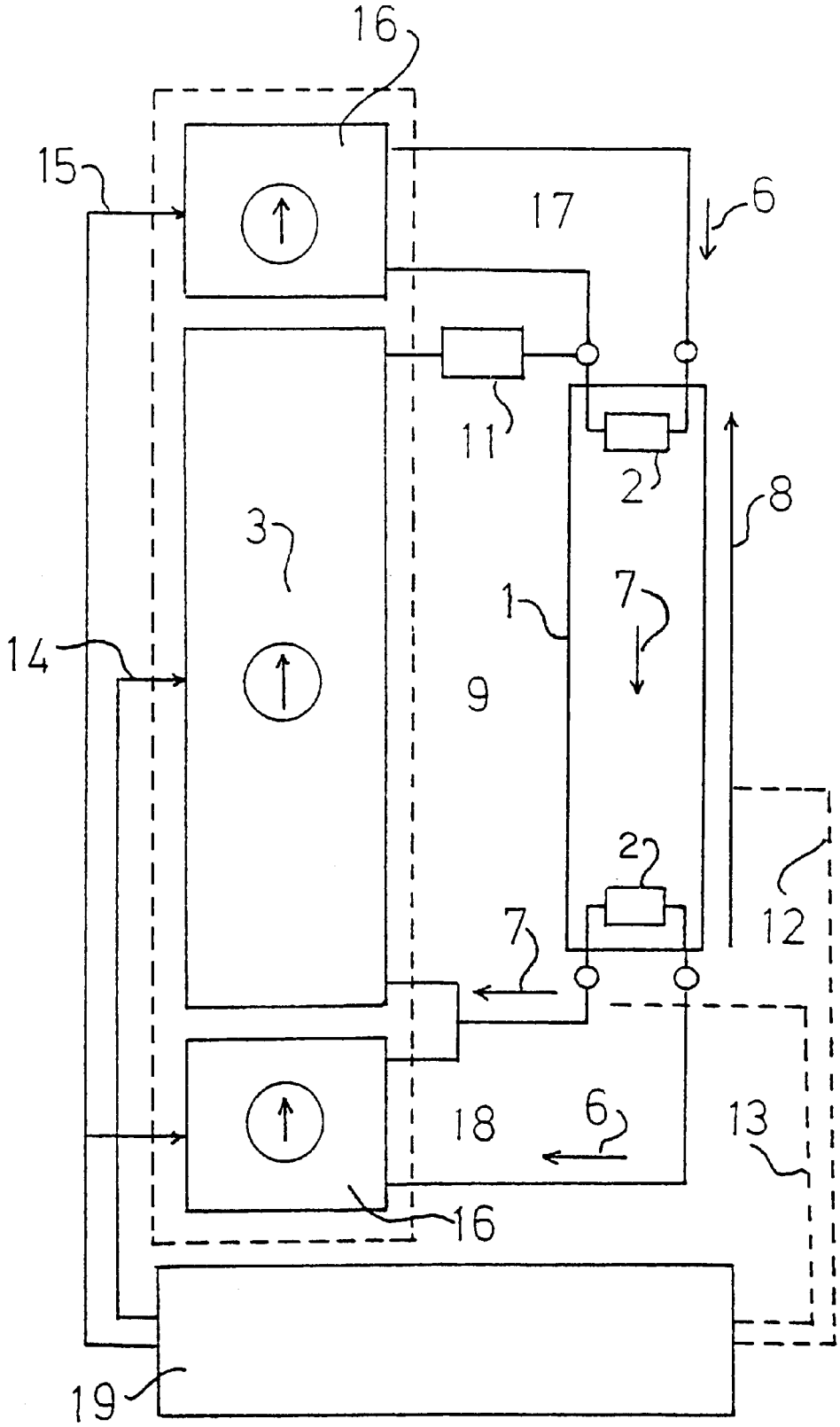
Fig 3 (PRIOR ART)
FIG. 3 shows a prior drive scheme for gas discharge lamps used in prior electronic control gears, where different way of filament supplying is presented.

Solutions based on ideas presented in FIG. 1 and FIG. 2 do not optimize the filament heating voltage while the lamp operates in dimmable mode. To avoid that some designs utilize an approach presented in FIG. 3. Filaments 2 are supplied from independent and regulated voltage sources 16, while discharge current 7 is supplied from another voltage source 3. Regulated voltage sources 16 are used to increase heating current while the lamp enters dimming mode providing optimal filament temperature and prolonging lifetime of lamp.

Different types and families of gas discharge lamps require different heating current, different discharge current having different discharge voltage. Because discharge loop and heating loop are reciprocally dependent in drive scheme presented in FIG. 1 and FIG. 2, parameters of particular components have to be adjusted to only one type of the gas discharge lamp and that yields to electronic and magnet control gears designed for only one type of the lamp. Supplying the lamp from voltage source requires also additional passive impedance component, usually magnetic, to limit the discharge current taken from voltage source to the value required by given lamp.

Figure 4:
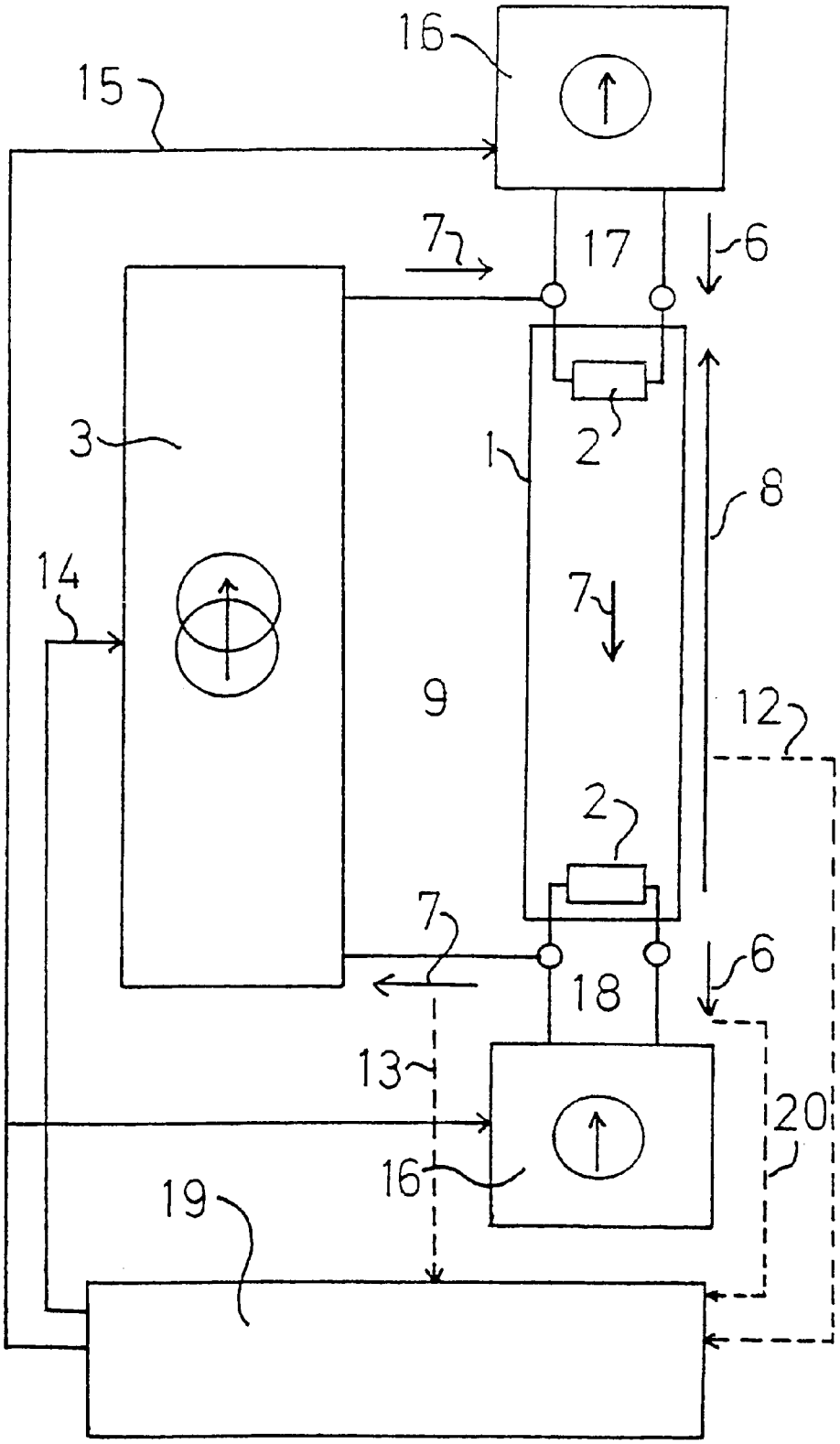
FIG. 4 shows a new drive scheme for gas discharge lamps providing automatic detection of lamp types and automatic adjustment of supplying parameters.

According to the principles of present invention, FIG. 4 shows a drive scheme for low pressure gas discharge lamp providing independent way of supplying discharge current and filament heating currents. Fluorescent lamp 1 with two filaments 2 has been used as an example of low pressure gas discharge lamp. Discharge current 7 is delivered from high frequency current source 3. Heating currents 6 are delivered to appropriate filaments from totally separate energy sources 16. Because both discharge current 7 and heating currents 6 are flowing in independent circuit loops 9, 17 and 18 and the above mentioned currents are delivered from independent current and voltage sources, their values can be regulated independently. Both types of sources are regulated in electronic way allowing independent adjustment of discharge current and heating voltage. Computer based control module senses the value of discharge voltage across the lamp with the aid of signal 12, the value of discharge current 7 with the aid of signal 13, the value of heating voltage 21 with the aid of signal 22 and the value of heating current 6 with the aid of signal 20. The information of the value of discharge current 7, discharge voltage 8, heating voltage 21 and heating current 6 during start-up and later on is used to perform detection of the type of the lamp, control module automatically adjusts the discharge current and heating voltage to the values required by the actually driven type of the tube.

What is claimed is:

1. Drive scheme for low pressure gas discharge lamps, driving one or more lamps, comprising:

independently regulated high frequency current sources supplying the discharge currents directly to the lamps, independently regulated voltage sources supplying the heating currents to every filament, a control module having means to sense the value of discharge currents, discharge voltages, heating voltage and heating currents, a control module having means to regulate the value of current delivered by discharge current sources, a control module having means to regulate the value of voltage delivered by voltage sources supplying filaments, a control module capable, after sensing the value of discharge voltages, discharge currents, heating voltage and heating current, to detect the type of driven lamp and independently regulate the value of discharge current and heating voltage in the way providing proper values of discharge current and heating current for actually driven type of lamp.

* * * * *